US006897837B1

(12) United States Patent
Sakumoto et al.

(10) Patent No.: US 6,897,837 B1
(45) Date of Patent: May 24, 2005

(54) SELF-LUMINOUS DISPLAY ELEMENT DRIVING DEVICE

(75) Inventors: Kazumi Sakumoto, Chiba (JP); Hiroshi Odagiri, Chiba (JP); Susumu Fujita, Chiba (JP); Masafumi Hoshino, Chiba (JP); Tokuya Akase, Chiba (JP)

(73) Assignee: Seiko Instruments Inc., Chiba (JP)

( * ) Notice: Subject to any disclaimer, the term of this patent is extended or adjusted under 35 U.S.C. 154(b) by 579 days.

(21) Appl. No.: 09/638,214

(22) Filed: Aug. 11, 2000

(30) Foreign Application Priority Data

Aug. 17, 1999 (JP) ..... 11-230490

(51) Int. Cl.[7] ..... G09G 3/30

(52) U.S. Cl. ..... 345/76; 345/77; 345/78; 345/36

(58) Field of Search ..... 345/77, 76, 78, 345/55, 56, 45, 36, 39, 33; 315/169.3, 169.1

(56) References Cited

U.S. PATENT DOCUMENTS 5,427,858 A * 6/1995 Nakamura et al.
6,061,041 A * 5/2000 Yoshida
6,069,676 A * 5/2000 Yuyama
6,078,302 A * 6/2000 Suzuki

* cited by examiner

*Primary Examiner*—Matthew C. Bella
*Assistant Examiner*—Hau Nguyen
(74) *Attorney, Agent, or Firm*—Adams & Wilks

(57) ABSTRACT

In the device for voltage driving the self-luminous display element, the self-luminous display element driving device includes a circuit for generating deterioration information concerning a deterioration state of the self-luminous display element, and a circuit for adjusting a voltage applied to the self-luminous display element, on the basis of the deterioration information generated by the deterioration information generating circuit. The deterioration information generating circuit generates the deterioration information on the basis of a time, a luminance, a current value or a voltgage value, etc. The self-luminous display element may be, for example, an EL (electroluminescence) element or an organic EL element.

24 Claims, 6 Drawing Sheets

SELF-LUMINOUS DISPLAY ELEMENT DRIVING DEVICE

BACKGROUND OF THE INVENTION

1. Field of the Invention

The present invention relates to a driving device for driving a self-luminous display element, such as an EL (electroluminescence) element or an organic EL element, and more particularly to a driving device for voltage driving a self-luminous display element.

2. Description of the Related Art

In recent years, as a self-luminous display element, an EL (electroluminescence) element and an organic EL element have been put into practical use. The organic EL element realizes high luminance light emission and high efficiency, is driven with a DC low voltage, and has a high speed response. Therefore it is ideal for use as a light emitting display. Such a self-luminous display element has the following features: its light emission luminance is proportional to current density, as shown in FIG. 6; and its V-I characteristics are changed with the elapse of time, as shown in FIGS. 7 and 8, that is, it is deteriorated with time so that a voltage necessary for a current of a constant value to flow is changed. As a driving method of the self-luminous display element, there are two kinds of methods, constant-current driving and constant-voltage driving.

As a conventional driving device for driving the self-luminous display element, there is known a circuit for performing constant-current driving. In the case where the self-luminous display element is divided into a plurality of segments or dots, this constant-current driving circuit is provided for the respective dots or segments on a one-to-one basis, and drives the respective segments or dots. According to the constant-current driving circuit, since a constant current is supplied to the self-luminous display element, even if the self-luminous display element is deteriorated and the V-I characteristics are changed, a supplied current is not changed nor is the luminance changed.

However, since this conventional constant-current driving circuit must be provided for each dot or segment on a one-to-one basis, there have been disadvantages in that the device becomes large or complicated, and the cost is increased. Particularly, in the case where the areas of the respective segments are different from each other, since different constant-current driving circuits designed to correspond to the respective areas must be prepared, there has been a disadvantage in that the device becomes further complicated and the cost is increased.

As a conventional self-luminous display element driving device for solving the foregoing disadvantages, there is known a circuit for performing voltage driving. With respect to this voltage driving circuit, only one circuit is provided for a plurality of dots or segments, and applies a fixed constant voltage to the plurality of dots or segments. According to this voltage driving circuit, since only one voltage driving circuit is to be provided for the plurality of dots or segments, the device can be made simple or small, and the cost can be reduced.

However, according to the foregoing conventional voltage driving circuit, since a fixed constant voltage is applied to a self-luminous display element, there has been a problem in that in the case where the V-I characteristics of the self-luminous display element is changed with the elapse of time, current flowing to the self-luminous display element is changed by this and the luminance of the self-luminous display element is changed, so that suitable luminance can not be obtained.

SUMMARY OF THE INVENTION

The present invention has been made in view of the above, and an object of the invention is to prevent the luminance of a self-luminous display element from changing with the elapse of time and to reduce the cost.

In order to achieve the foregoing object, in a self-luminous display element driving device for voltage driving a self-luminous display element, the self-luminous display element driving device of the present invention includes generation means for generating deterioration information relative to a deterioration state of the self-luminous display element so that an applied voltage is changed in accordance with the deterioration state of the self-luminous display element, and adjustment means for adjusting the voltage applied to the self-luminous display element on the basis of the deterioration information generated by the generation means. That is, the adjustment means increases or decreases a voltage value of the applied voltage so that the brightness of the self-luminous display element is not changed.

Here, the generation means may measure a time to generate the deterioration information on the basis of an elapsed time, or may detect the luminance of a part or all of the self-luminous display element to generate the deterioration information on the basis of the luminance. Besides, the generation means may detect a current flowing to a part or all of the self-luminous display element to generate the deterioration information on the basis of a current value, or may include means for constant-current driving a part or all of the self-luminous display element and detect a voltage drop by the self-luminous display element, which is constant-current driven by the means, to generate the deterioration information on the basis of a voltage value. Further, the self-luminous display element may be an electroluminescence element or an organic electroluminescence element.

DETAILED DESCRIPTION OF THE PREFERRED EMBODIMENTS

Preferred embodiments of the present invention will be described with reference to the accompanying drawings in the order of embodiment 1 to embodiment 4.

Embodiment 1

Figure 8:
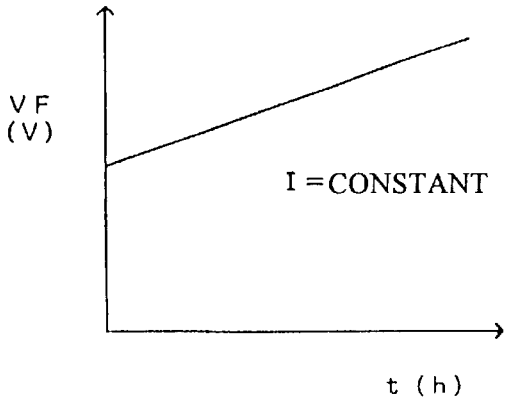
FIG. 8 is a view showing the relation between the driving voltage of the conventional self-luminous display element and the elapsed time.

As a self-luminous display element driving device of embodiment 1, for example, in the case where an organic EL (electroluminescence) element is applied as a 7 segment display forming a FIG. 8 for numerical display in an electronic wristwatch, a self-luminous display element driving circuit for driving this organic EL element will be cited as an example. Note that, in the embodiment 1, although the electronic wristwatch is cited as an example, the invention is not limited to this example, but may be applied to other electronic watches or various instruments using self-luminous display elements. Besides, instead of the segment display, other display methods, for example, dot matrix display may be used. Further, instead of the organic EL, other self-luminous display elements, for example, AC driven EL may be used.

Figure 1:
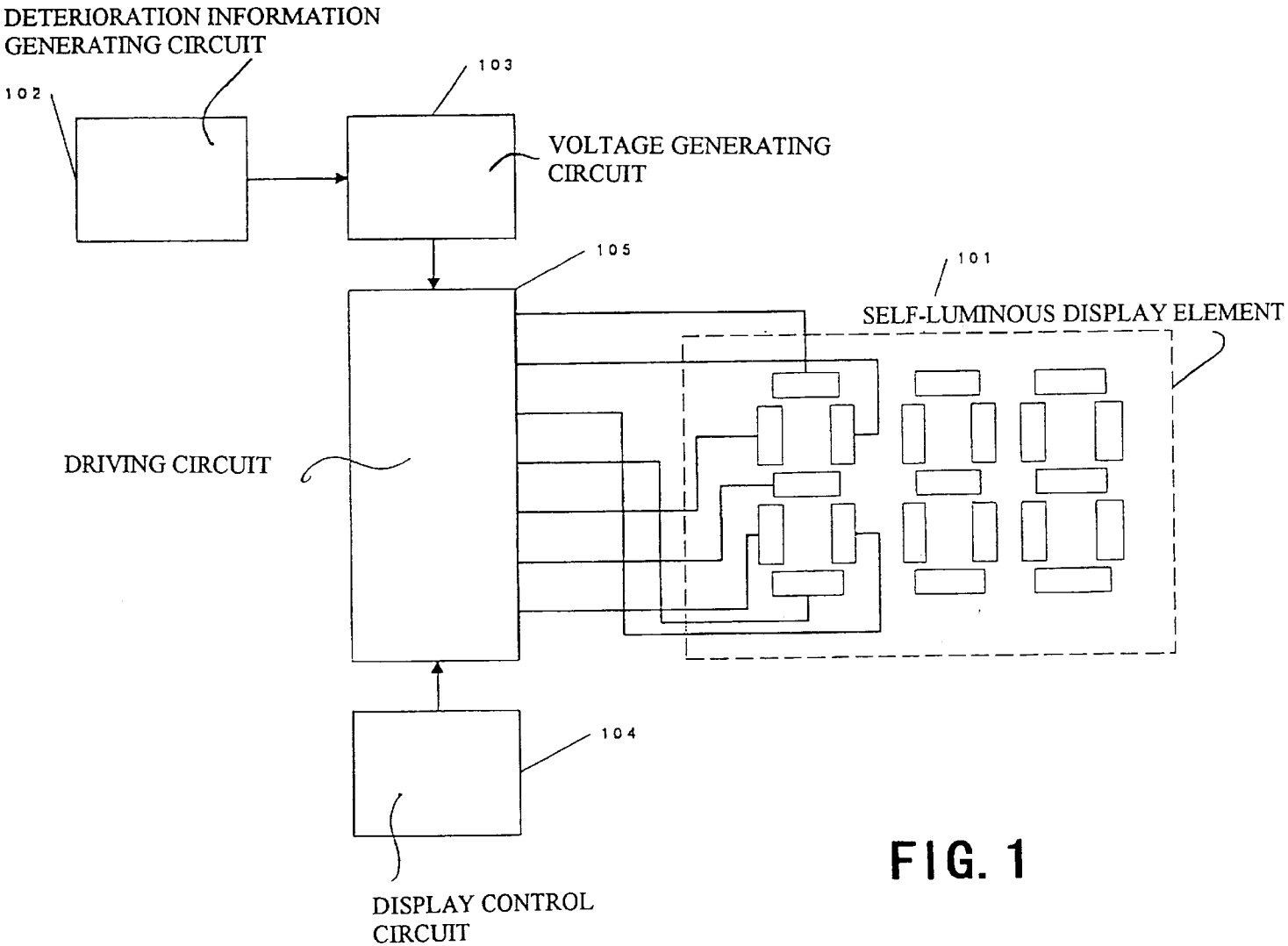
FIG. 1 is a view showing a schematic structure of a self-luminous display element driving circuit according to embodiment 1 of the present invention.

FIG. 1 is a view showing a schematic structure of a self-luminous display element driving circuit according to the embodiment 1 of the present invention. The self-luminous display element driving circuit of the embodiment 1 includes a circuit 102 for generating deterioration information concerning a deterioration state of a self-luminous display element 101, a circuit 103 for generating a driving voltage of the self-luminous display element 101, a display control circuit 104 for controlling on and off states of voltage application to respective segments (display elements) of the self-luminous display element 101 in accordance with a figure to be displayed, and a driving circuit 105 for making the on and off states of voltage application to the respective segments of the self-luminous display element 101.

Figure 2:
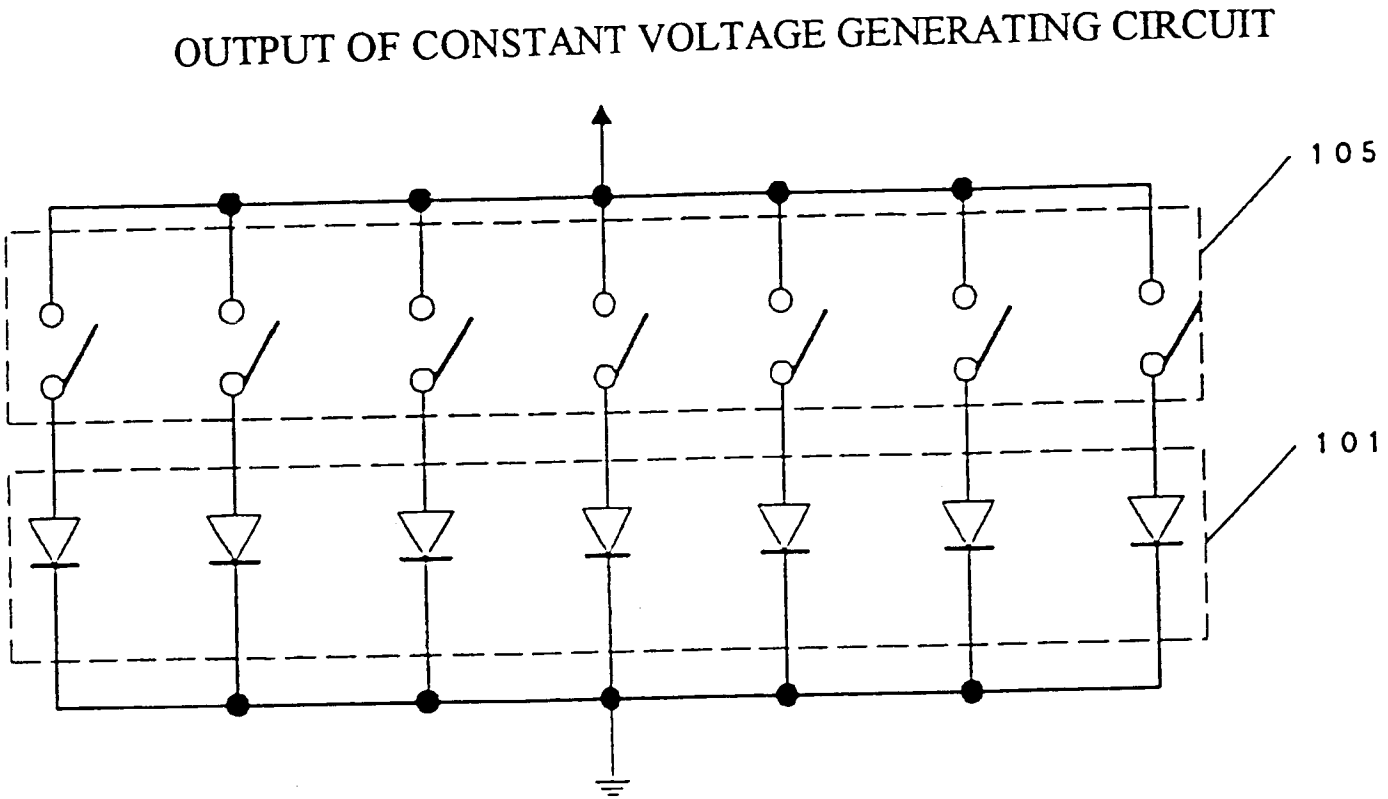
FIG. 2 is a view showing a schematic structure of a driving circuit and a self-luminous display element shown in FIG. 1.

FIG. 2 is a view showing a schematic structure of the driving circuit 105 and the self-luminous display element 101 shown in FIG. 1. As shown in the drawing, the driving circuit 105 is constituted by switches respectively corresponding to each segment of the self-luminous display element 101, and pairs each including the segment of the self-luminous display element 101 and the switch of the driving circuit 105 are provided in parallel with each other. In this structure, when one of the switches of the driving circuit 105 is switched on, the corresponding segment of the self-luminous display element 101 becomes bright, and when one of the switches of the driving circuit 105 is switched off, the corresponding segment of the self-luminous display element 101 becomes dark. Note that, in this embodiment, although one switch is provided for one segment, a plurality of switches may be provided for one segment.

In the above structure, the operation of the self-luminous display element driving circuit according to the embodiment 1 will be described with reference to FIG. 1. In the operation of the self-luminous display element driving circuit according to the embodiment 1, the deterioration information generating circuit 102 uses clocking information from the electronic watch or a clock signal from another circuit to measure an elapsed time from the manufacture of the self-luminous display element 101 or from some point of time after the manufacture, and generates the deterioration information on the basis of the elapsed time, for example, "1" until 10000 hours, or "2" from 10000 hours to 20000 hours. The voltage generating circuit 103 changes a voltage to be generated, that is, a driving voltage of the self-luminous display element 101 on the basis of the deterioration information generated by the deterioration information generating circuit 102, for example, the voltage is made 3 V when the deterioration information is "1", or the voltage is made 3.1 V when the deterioration information is "2". By this, the voltage is adjusted on the basis of the deterioration information, and the luminance of the self-luminous display element 101 is kept constant irrespective of the temporal change of V-I characteristics of the self-luminous display element 101.

The display control circuit 104 outputs lighting/non-lighting information for making on-off control of voltage application, and the driving circuit 105 applies the driving voltage generated by the voltage generating circuit 103 to the respective segments of the self-luminous display element 101 on the basis of the light/non-lighting information from the display control circuit 104. By this, predetermined segments emit light and a figure is displayed.

The self-luminous display element driving circuit of the embodiment 1 may perform static driving in which it continues applying a voltage to the self-luminous display element 101 or may perform dynamic driving in which it repeats on and off operations of voltage application. In the case of the dynamic driving, for example, the display control circuit 104 outputs a control pulse for causing continuous on and off operations of voltage application to the self-luminous display element 101. The driving circuit 105 performs the on and off operations of voltage application to the respective segments of the self-luminous display element 101 on the basis of the control pulse from the control circuit 104. By this, the self-luminous display element 101 repeats on and off states. Here, the on and off states are repeated at an interval shorter than an afterimage time of a human eye, a person sees the self-luminous display element 101 as if it remains being turned on.

As described above, according to the embodiment 1, since voltage driving is performed, and only one voltage generating circuit is provided for the plurality of segments, as compared with the case of: performing constant-current driving in which one constant-current generating circuit must be provided for each segment, the structure of its device can be made simple or small, and the cost can be reduced. Besides, since the time is measured to generate the deterioration information on the basis of the time, and an applied voltage to the self-luminous display element is adjusted on the basis of the deterioration information, it is possible to prevent the luminance of the self-luminous display element from changing with the elapse of time, which has been a problem in the voltage driving. Especially in the case where the deterioration information generating circuit uses a clock signal from the electronic watch or other circuits, since it is not necessary to prepare a clock signal generating circuit for the deterioration information generating circuit, the cost can be further reduced.

Embodiment 2

A self-luminous display element driving circuit of embodiment 2 has a similar structure to the self-luminous display element driving circuit of the embodiment 1, and its operation is also similar thereto. However, a circuit 301 for generating deterioration information on the basis of luminance is provided instead of the circuit 102 for generating the deterioration information on the basis of time. Hereinafter, the deterioration information generating circuit as a portion different from the embodiment 1 will be described with reference to FIG. 3.

Figure 3:
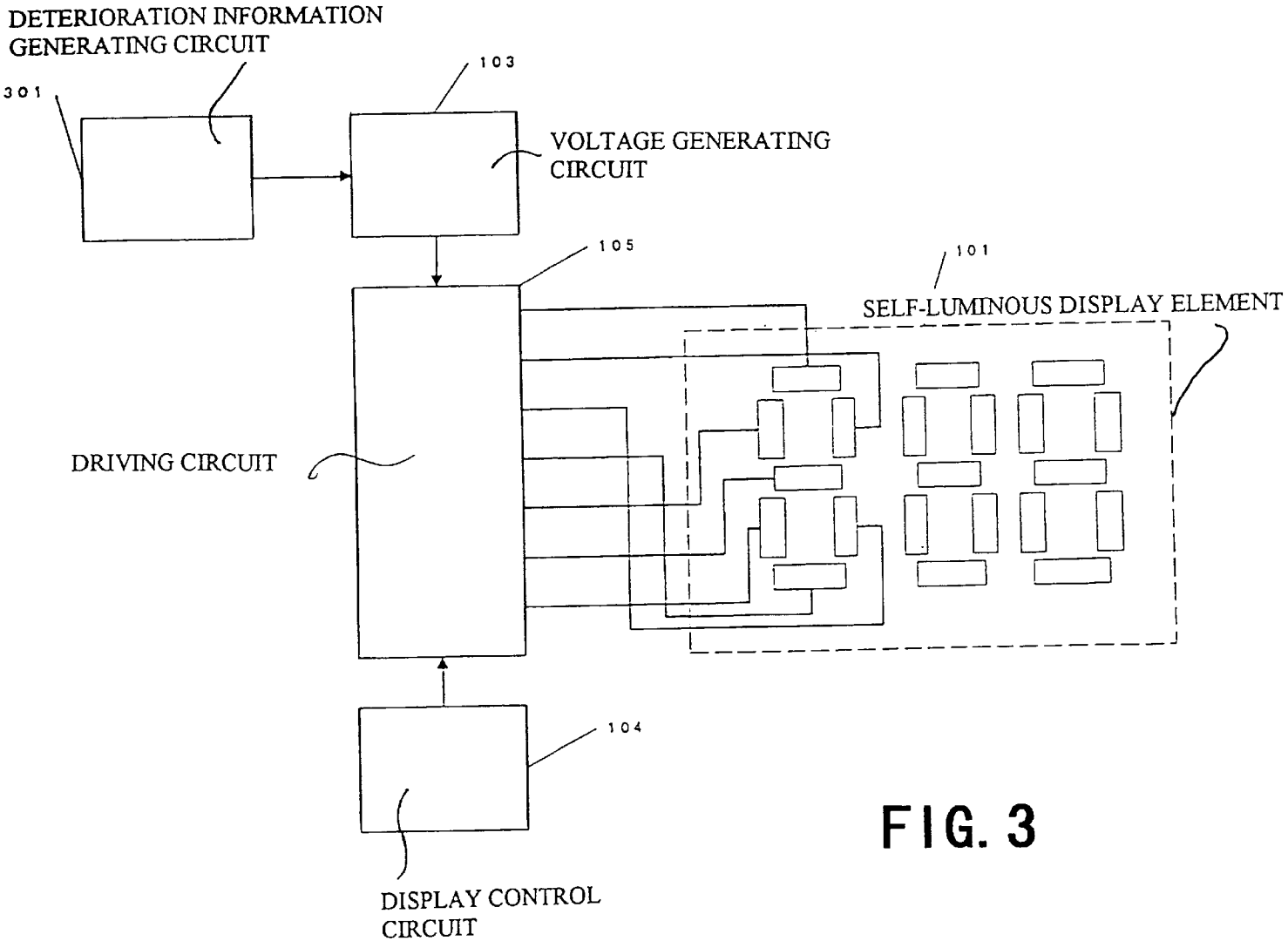
FIG. 3 is a view showing a schematic structure of a self-luminous display element driving circuit according to embodiment 2 of the present invention.

FIG. 3 is a view showing a schematic structure of the self-luminous display element driving circuit according to the embodiment 2 of the present invention. The same parts as those of FIG. 1 are designated by the same symbols and their description is omitted. In the self-luminous display element driving circuit of the embodiment 2, a deterioration information generating circuit 301 is provided instead of the deterioration information generating circuit 102 shown in FIG. 1. The deterioration information generating circuit 301 includes a not-shown optical sensor, detects the luminance of the self-luminous display element 101, and generates deterioration information on the basis of the luminance. With respect to the optical sensor, one sensor may be provided near one segment, or a plurality of sensors may be provided near a plurality of segments. Note that since the optical sensor is a conventional technique well known to one skilled in the art, the description is omitted.

In the above structure, the operation of the embodiment 2 will be described. In accordance with a detection signal from a not-shown optical sensor, the deterioration information generating circuit 301 generates the deterioration information on the basis of luminance, for example, by adding "1" to deterioration information in the case where a luminance of 20 candela per square meter is lowered, and outputs it to the voltage generating circuit 103. The voltage generating circuit 103 receives the deterioration information, and adjusts a generated voltage so that the voltage becomes, for example, 3.0 V when the deterioration information is "1", or 3.1 V when the deterioration information is "2". That is, the luminance of the self-luminous display element 101 is directly detected, and the driving voltage of the self-luminous display element 101 is adjusted.

According to the foregoing embodiment 2, since the luminance of the self-luminous display element is directly detected and is adjusted, the brightness of the self-luminous display element can be adjusted more accurately.

Embodiment 3

A self-luminous display element driving circuit of embodiment 3 has a similar structure to the self-luminous display element driving circuit of embodiment 1 and its operation is also similar thereto. However, a circuit 401 for generating deterioration information on the basis of current flowing through the self-luminous display element 101 is provided instead of the circuit 102 for generating deterioration information on the basis of time. Hereinafter, the deterioration information generating circuit as a portion different from embodiment 1 will be described with reference to FIG. 4.

Figure 4:
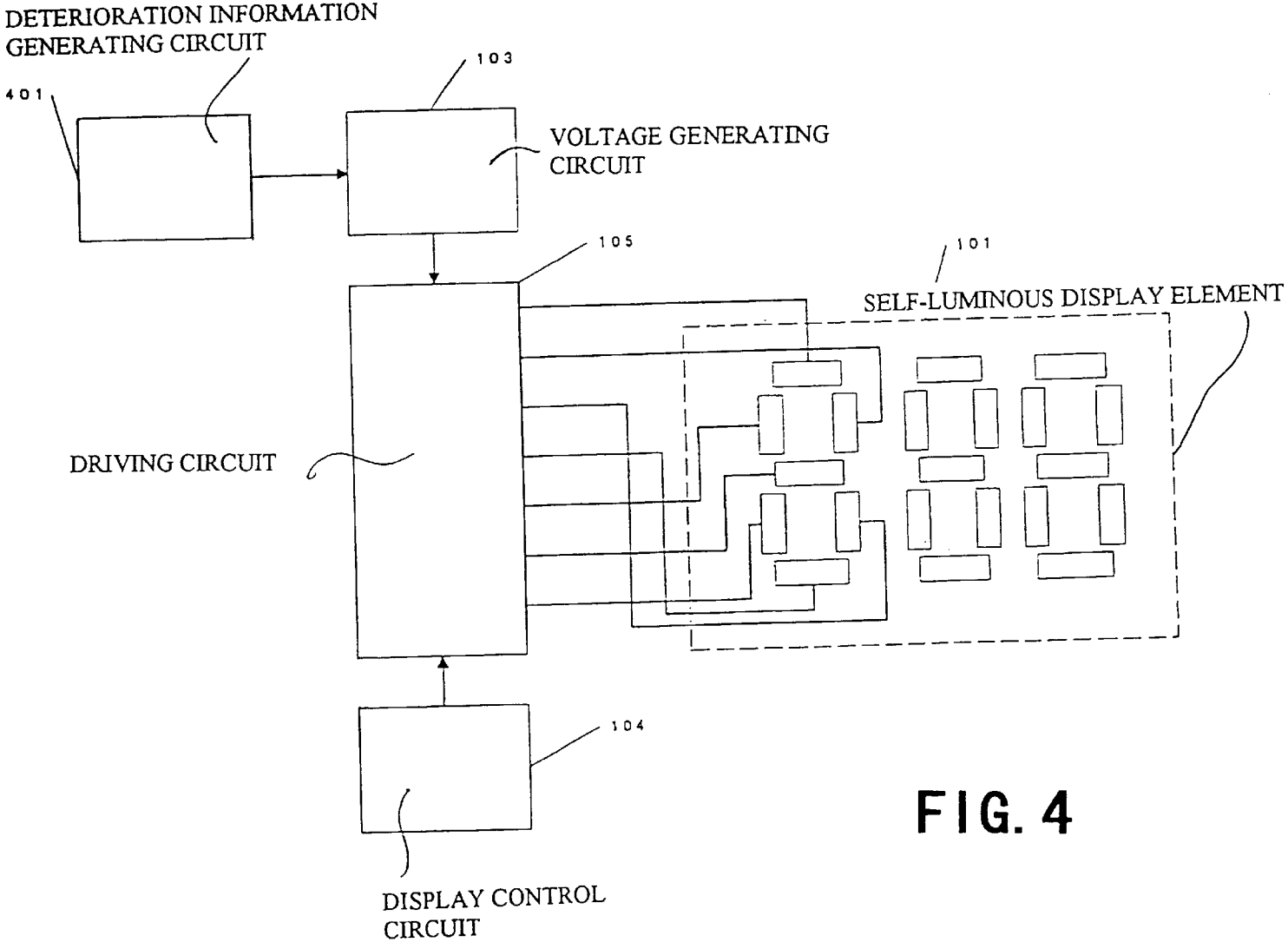
FIG. 4 is a view showing a schematic structure of a self-luminous display element driving circuit according to embodiment 3 of the present invention.

FIG. 4 is a view showing a schematic structure of the self-luminous display element driving circuit according to the embodiment 3 of the present invention. Note that the same portions as those of FIG. 1 are designated by the same symbols and their description is omitted. In the self-luminous display element driving circuit of the embodiment 3, a deterioration information generating circuit 401 is provided instead of the deterioration information generating circuit 102 shown in FIG. 1. The deterioration information generating circuit 401 includes a not-shown current detecting circuit, detects a current flowing through the whole of the self-luminous display element 101 or its partial segments, and generates deterioration information on the basis of the current. The current detecting circuit may be provided at a current passage of one segment or may be provided at a current passage of the whole of the self-luminous display element 101. Note that since the current detecting circuit is a conventional technique well known to one skilled in the art, the description is omitted.

In the above structure, the operation of the embodiment 3 will be described. In accordance with a detection signal from the not-shown current detecting circuit, the circuit 401 generates deterioration information, for example, "1" in the case where a current of 10 mA flows, or "2" in the case where a current of 11 mA flows, and outputs it to the voltage generating circuit 103. The voltage generating circuit 103 receives the deterioration information, and adjusts a generated voltage so that the voltage becomes, for example, 3.0 V when the deterioration information is "1", or 3.1 V when the deterioration information is "2". That is, the current flowing through the self-luminous display element 101 is detected, and the driving voltage of the self-luminous display element 101 is adjusted.

According to the foregoing embodiment 3, since the current in proportion to the luminance of the self-luminous display element is directly detected to adjust a voltage applied to the self-luminous display element, the brightness of the self-luminous display element can be adjusted more accurately.

Embodiment 4

A self-luminous display element driving circuit of embodiment 4 has a similar structure to the self-luminous display element driving circuit of the embodiment 1 and its operation is also similar thereto. However, a circuit for generating deterioration information on the basis of voltage drop caused by the self-luminous display element 101 is provided instead of the circuit 102 for generating the deterioration information on the basis of time. Hereinafter, the deterioration information generating circuit as a portion different from the embodiment 1 will be described with reference to FIG. 5.

Figure 5:
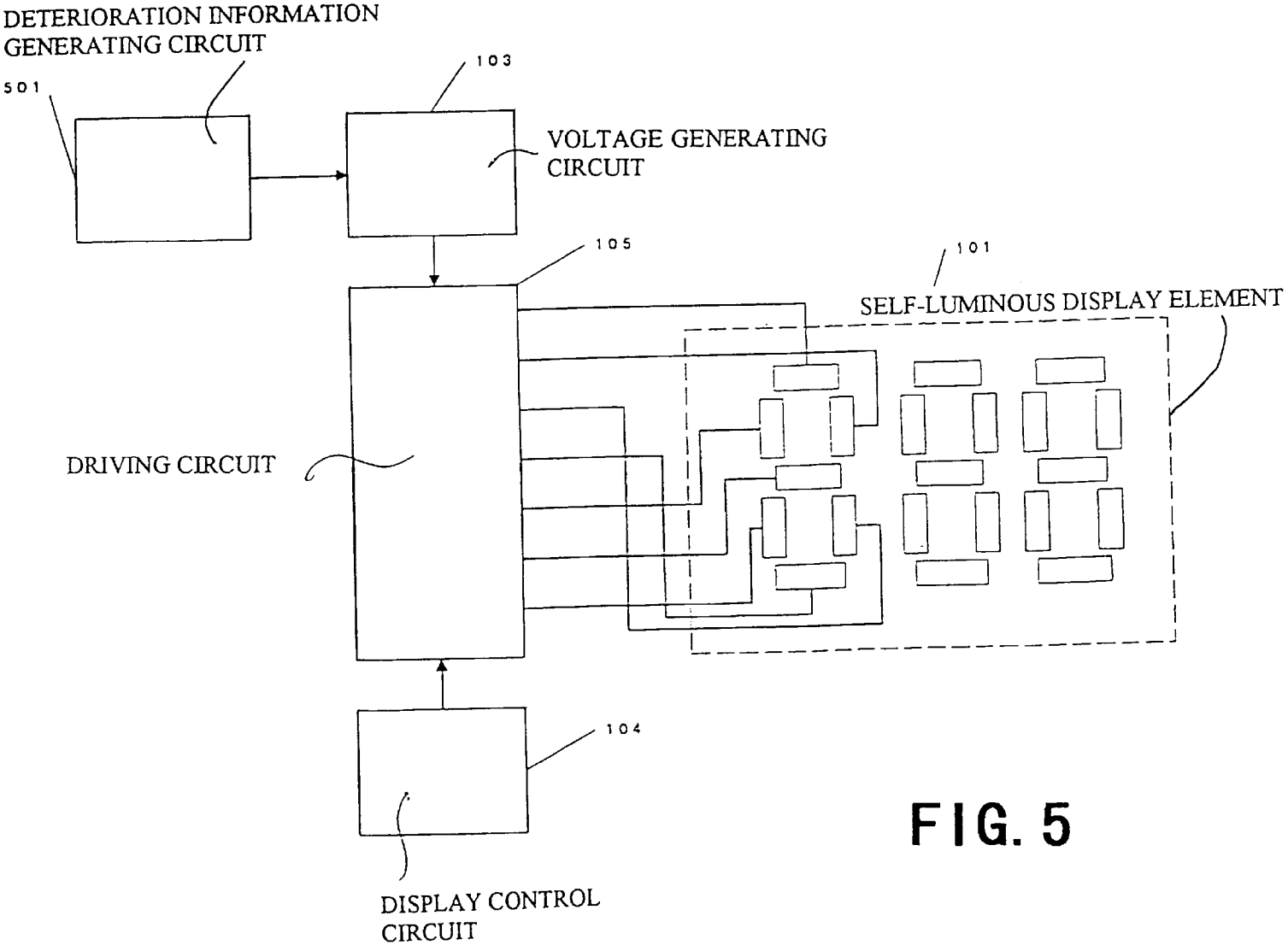
FIG. 5 is a view showing a schematic structure of a self-luminous display element driving circuit according to embodiment 4 of the present invention.
Figure 6:
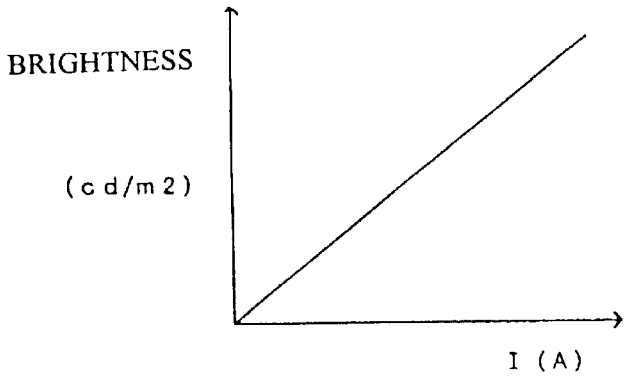
FIG. 6 is a view showing the relation between the driving current and the luminance of a conventional self-luminous display element.
Figure 7:
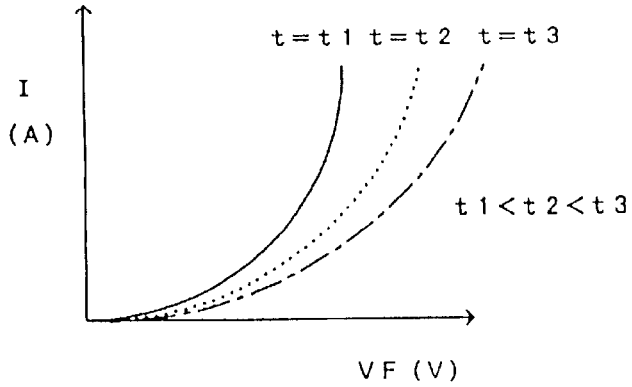
FIG. 7 is a view showing the V-I characteristics of the conventional self-luminous display element.

FIG. 5 is a view showing a schematic structure of the self-luminous display element driving circuit according to the embodiment 4 of the present invention. Note that the same portions as those of FIG. 1 are designated by the same symbols and their description is omitted. In the self-luminous display element driving circuit of the embodiment 4, a deterioration information generating circuit 501 is provided instead of the deterioration information generating circuit 102 shown in FIG. 1. The deterioration information generating circuit 501 includes a not-shown constant-current driving circuit and a voltage detecting circuit.

This constant-current driving circuit makes constant-current driving of one segment of the self-luminous display element 101, and the voltage detecting circuit detects a voltage drop caused by the segment which is constant-current driven by this constant-current driving circuit. That is, the circuit detects what voltage is needed to supply a constant current. The circuit 501 generates deterioration information on the basis of the detection result of the voltage detecting circuit.

Here, the segment which is constant-current driven by the constant-current driving circuit may always be constant-current driven, instead of being voltage driven, or it may be normally voltage driven and only when the deterioration information is generated, constant-current driving may be made. In the case of changing to the constant-current driving in order to generate the deterioration information, it may be automatically performed in the middle of the night by using time information of an electronic watch. Note that since the constant-current driving circuit and the voltage detecting circuit are conventional techniques well known to one skilled in the art, their description is omitted.

In the foregoing structure, the operation of the embodiment 4 will be described. In accordance with a detection signal from the not-shown voltage detecting circuit, the circuit 501 generates deterioration information, for example, "1" in the case where the voltage drop is 3.0 V, or "2" in the case where it is 3.1 V, and outputs the voltage generating circuit 103. The voltage generating circuit 103 receives the deterioration information, and adjusts a generated voltage so that the voltage becomes, for example, 3.0 V when the deterioration information is "1", or 3.1 V when the deterioration information is "2". That is, the deterioration information generating circuit 501 directly detects the voltage needed to supply a constant current to the self-luminous display element 101 and adjusts the voltage applied to the self-luminous display element 101.

According to the foregoing embodiment 4, since the voltage drop of the self-luminous display element is directly detected to adjust the voltage applied to the self-luminous display element, the brightness of the self-luminous display element can be adjusted more accurately.

As described above, according to the present invention, in the driving device for voltage driving the self-luminous display element, the self-luminous display element driving device generates the deterioration information concerning the deterioration state of the self-luminous display element, and adjust the voltage applied to the self-luminous display element on the basis of the deterioration information, so that it is possible to prevent the luminance of the self-luminous display element from changing with the elapse of time and to reduce the cost.

Besides, in the self-luminous display element driving device of the present invention, since the self-luminous display element is an electroluminescence element which deteriorates with the elapse of time and V-I characteristics of which are greatly changed, the prevention of luminance changes becomes especially effective.

Besides, in the self-luminous display element driving device of the present invention, since the self-luminous display element is an organic electroluminescence element which deteriorates with the elapse of time and V-I characteristics of which are greatly changed, the prevention of luminance changes becomes especially effective.

Besides, the self-luminous display element driving device of the present invention measures a time and generates deterioration information on the basis of the time, a clock signal for time measurement can be jointly owned with another circuit, and the cost can be further reduced.

Besides, since the self-luminous display element driving device of the present invention detects the luminance of a part or all of the self-luminous display element and generates the deterioration information on the basis of the luminance, it is possible to more accurately prevent the luminance of the self-luminous display element from changing with the elapse of time.

Besides, since the self-luminous display element driving device of the present invention detects a current flowing through a part or all of the self-luminous display element and generates the deterioration information on the basis of the current value, it is possible to more accurately prevent the luminance of the self-luminous display element from changing with the elapse of time.

Besides, since the self-luminous display element driving device of the present invention makes constant-current driving of a part or all of the self-luminous display element, detects a voltage drop by the self-luminous display element which is constant-current driven, and generates the deterioration information on the basis of the voltage value, it is possible to more accurately prevent the luminance of the self-luminous display element from changing with the elapse of time.

What is claimed is:

1. A self-luminous display element driving device for voltage driving a self-luminous display element, comprising:

a driving circuit for driving the self-luminous display element by controlling the application of a driving voltage to the self-luminous display element;

a voltage generating circuit for supplying the driving voltage to the driving circuit; and a deterioration information generating circuit for detecting a voltage supplied to the self-luminous display element and generating deterioration information indicating an amount of deterioration of the self-luminous display element based on the detected voltage;

wherein the driving voltage generated by the voltage generating circuit is varied in accordance with the deterioration information generated by the deterioration information generating circuit so that the driving voltage is increased as the self-luminous display element deteriorates.

2. A self-luminous display element driving device according to claim 1; wherein the deterioration information generating circuit is driven intermittently in accordance with externally supplied time information.

3. A self-luminous display element driving device according to claim 1; wherein the self-luminous display element is an electroluminescent element.

4. A self-luminous display element driving device according to claim 1; wherein the self-luminous display element is an organic electroluminescent element.

5. A self-luminous display element driving device according to claim 1; wherein the self-luminous display element comprises a multi-segment alphanumeric display element, and the driving circuit controls the application of the driving voltage to respective segments of the multi-segment display element.

6. A self-luminous display element driving device according to claim 1; wherein the self-luminous display element has a plurality of display elements, and the driving circuit controls the application of voltage to the respective display elements.

7. A self-luminous display element driving device according to claim 1; wherein the driving circuit performs dynamic driving of the self-luminous display element by repeated on and off voltage application thereto at an interval shorter than an afterimage time of a human eye.

8. A self-luminous display element driving device according to claim 1; wherein the driving circuit performs static driving of the self-luminous display element by continuously applying a voltage to the display element.

9. A self-luminous display element driving device for voltage driving a self-luminous display element, comprising:

a driving circuit for driving the self-luminous display element by controlling the application of a driving voltage to the self-luminous display element;

a voltage generating circuit for supplying the driving voltage to the driving circuit; and a deterioration information generating circuit for generating deterioration information indicating an amount of deterioration of the self-luminous display element based on elapsed time;

wherein the driving voltage generated by the voltage generating circuit is varied based on the deterioration information such that the driving voltage is increased with the elapse of time.

10. A self-luminous display element driving device according to claim 9; wherein the deterioration information generating circuit is driven intermittently in accordance with externally supplied time information.

11. A self-luminous display element driving device according to claim 9; wherein the self-luminous display element is an electroluminescent element.

12. A self-luminous display element driving device according to claim 9; wherein the self-luminous display element is an organic electroluminescent element.

13. A self-luminous display element driving device according to claim 1; wherein the self-luminous display element comprises a multi-segment alphanumeric display element, and the driving circuit controls the application of voltage to respective segments of the multi-segment display element.

14. A self-luminous display element driving device according to claim 1; wherein the self-luminous display element has a plurality of display elements, and the driving circuit controls the application of voltage to the respective display elements.

15. A self-luminous display element driving device according to claim 1; wherein the driving circuit performs dynamic driving of the self-luminous display element by repeated on and off voltage application thereto at an interval shorter than an afterimage time of a human eye.

16. A self-luminous display element driving device according to claim 1; wherein the driving circuit performs static driving of the self-luminous display element by continuously applying a voltage to the display element.

17. A self-luminous display element driving device for voltage driving a self-luminous display element, comprising:

a driving circuit for driving the self-luminous display element by controlling the application of a driving voltage to the self-luminous display element;

a voltage generating circuit for supplying the driving voltage to the driving circuit;

a constant-current driving circuit for driving the self-luminous display element at a constant current; and a voltage detecting circuit for detecting a voltage drop across the self-luminous display element that is driven by the constant-current driving circuit; wherein the driving voltage generated by the voltage generating circuit is varied in accordance with the voltage drop detected by the voltage detecting circuit such that the driving voltage is increased to compensate for deterioration of the self-luminous display element.

18. A self-luminous display element driving device according to claim 17; wherein the self-luminous display element is an electroluminescent element.

19. A self-luminous display element driving device according to claim 17; wherein the self-luminous display element is an organic electroluminescent element.

20. A self-luminous display element driving device according to claim 17; wherein the deterioration information generating circuit is driven intermittently in accordance with externally supplied time information.

21. A self-luminous display element driving device according to claim 17; wherein the self-luminous display element comprises a multi-segment alphanumeric display element, and the driving circuit controls the application of voltage to respective segments of the multi-segment display element.

22. A self-luminous display element driving device according to claim 17; wherein the self-luminous display element has a plurality of display elements, and the driving circuit controls the application of voltage to the respective display elements.

23. A self-luminous display element driving device according to claim 17; wherein the driving circuit performs dynamic driving of the self-luminous display element by repeated on and off voltage application thereto at an interval shorter than an afterimage time of a human eye.

24. A self-luminous display element driving device according to claim 17; wherein the driving circuit performs static driving of the self-luminous display element by continuously applying a voltage to the display element.

* * * * *